United States Patent [19]

Showalter

[11] Patent Number: 4,589,383

[45] Date of Patent: May 20, 1986

[54] SQUEEZE FILM ROCKER TIP

[75] Inventor: Merle R. Showalter, Madison, Wis.

[73] Assignee: Automotive Engine Associates, Madison, Wis.

[21] Appl. No.: 502,574

[22] Filed: Jun. 9, 1983

[51] Int. Cl.[4] ..... F01L 1/46

[52] U.S. Cl. ..... 123/90.36; 123/90.46

[58] Field of Search ..... 123/90.39, 90.35, 90.36, 123/90.43, 90.46, 90.44; 74/559

[56] References Cited

U.S. PATENT DOCUMENTS

| | | | |
|---|---|---|---|
| 1,515,201 | 11/1924 | Hewitt | 123/90.39 |
| 1,930,368 | 10/1933 | Nelson | 123/90.36 X |
| 2,000,635 | 5/1935 | Edwards | 123/90.36 |
| 2,158,272 | 5/1939 | Chilton | 123/90.39 X |
| 2,322,173 | 6/1943 | Spencer | 123/90.36 |
| 3,016,887 | 1/1962 | Streit et al. | 123/90.44 X |
| 3,855,981 | 12/1974 | Loon | 123/90.36 X |

*Primary Examiner*—William R. Cline
*Assistant Examiner*—Peggy Neils
*Attorney, Agent, or Firm*—Witherspoon & Hargest

[57] ABSTRACT

Side loads on the valve guide due to rocker tip sliding can be essentially eliminated with a rocker tip which maintains a squeeze film of oil between the valve tip and the rocker tip. This squeeze film of oil between rocker tip and valve tip can be arranged with a special rocker tip involving a spherical lubricated support, a flat section engaging the flat plane of the valve tip spring, means to produce a clearance between the rocker tip and the valve tip during the periods when the valve is closed, and lubricant supply means to assure that oil is present between the rocker tip and the valve tip to replenish the film when the valve is closed. During the closed or unloaded period, a film of oil is established between the rocker tip and valve guide. This oil film is not completely squeezed out when the valve is actuated due to the squeeze film effect. Because of the full film of oil between the valve tip and the rocker tip, the friction side force produced by the rocker tip actuation is radically reduced.

2 Claims, 2 Drawing Figures

SQUEEZE FILM ROCKER TIP

BACKGROUND AND OBJECTS

Valve train friction is a significant fraction of total engine friction. It is therefore desirable to reduce the frictional work between the sliding parts of the engine valve train to improve the fuel efficiency of the engine. Because of the necessity to control oil flow past the valve guides, and also because the valve stems are hot, the lubrication conditions between valve stems and valve guides are typically marginal, and the friction between these sliding parts is Coulomb friction. A reduction in the side loads on the valve stem with respect to the valve guide will produce a proportionate reduction in this friction, and will also reduce valve guide wear. Reduction in side loads will also make it possible to install more restrictive valve guide seals. It is the purpose of the present invention to radically reduce the side forces on the valve stem due to actuation of the valve by the rocker tip. Although the frictional work in sliding between a conventional rocker tip and the valve stem is not in itself large, the frictional work produced by side forces on the valve is significant. The wear problem is similarly significant.

The sliding velocities between a rocker tip and the valve tip are very small even at high engine speeds, and the contact pressures are high. However, the valves in an internal combustion engine are only actuated approximately 30 percent of the time, and are unloaded otherwise. This is an ideal situation for squeeze film lubrication, since there is a significant amount of time available for replenishing an oil film between load applications which squeeze the oil film out from between the sliding surfaces. By maintaining a squeeze film between the rocker tip and the valve tip, the side friction forces of rocker tip actuation on the valve stem can be reduced by more than a factor of 100, producing corresponding reductions in valve actuating friction and reductions in valve guide wear.

IN THE DRAWINGS

DETAILED DISCUSSION

Figure 1:
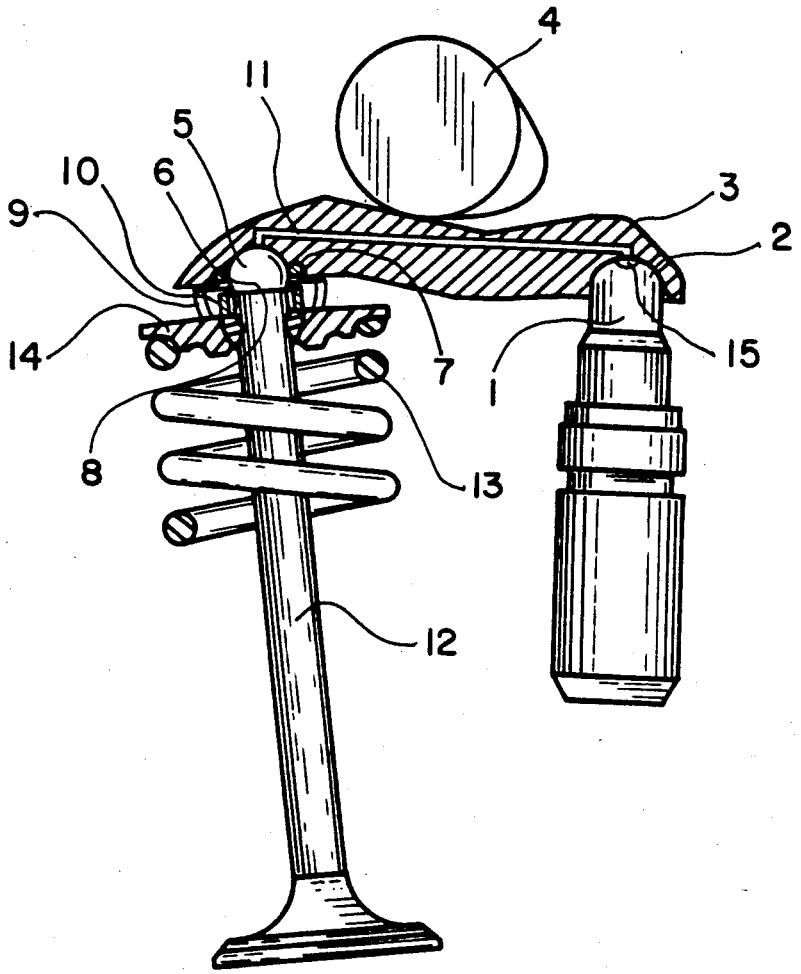
FIG. 1 illustrates the squeeze film rocker tip arrangement for the valve geometry of an overhead cam engine equipped with a cam follower, in this case specifically the geometry for the 2.3L Ford engine.

See FIG. 1. A hydraulic lash adjuster 1 which mounts into the cylinder head (not shown) delivers a supply of oil through its generally spherical end 2 which connects to cam follower 3 which engages camshaft 4 in a conventional fashion. Cam follower 3 has mounted within it a spherical receiver section which mounts a ball bearing or similar sphere 5 which has a flat rocker tip valve stem engaging surface 6 which engages the valve 12 at its flat valve tip surface 8. Sphere 5 is held into its spherical receiver section by means of retainer clip 7. The valve is mounted with a spring 13 and a valve spring retainer 14 in conventional fashion. Between valve spring retainer 14 and cam follower 3 is finger spring washer assembly 9 which serves to produce a small returning force which tends to separate the surfaces 6 and 8 between the valve keeper and the rocker tip under conditions when the cam is unloaded. This assures that the small degree of lash which naturally occurs in the function of hydraulic lash adjuster 1 is available to separate the surfaces 6 and 8 when the valve is not being actuated by the cam follower. Surrounding the valve stem adjacent the valve tip is cylindrical piece 10 which serves as a peripheral wall for a small oil reservoir. Oil from the hydraulic lash adjuster 1 passes through passage 15 and passage 11 in cam follower 3 to supply the spherical surface of rocker tip 5 with oil flowing downwardly into the reservoir formed between the valve stem upper top portion and surrounding peripheral wall to assure that there is oil surrounding valve stem tip flat surface 8 and rocker tip flat surface so that when these two flat surfaces are separated upon the valve being closed, oil from the reservoir will flood the space between the separated flat surfaces 6.

As the engine operates, this assembly establishes and maintains a full film of oil separating surfaces 6 and 8 so that actuation produces only very small side forces on the stem of valve 12.

The squeeze film rocker tip functions as follows. During the period in the engine cycle when the valve is not actuated, spring 9 produces a small separation between the valve tip surface 8 and rocker tip surface 6, and oil surrounding those surfaces is sucked into this separation. When the cam rotation starts to actuate the valve, large forces push together rocker tip surface 6 and valve tip surface 8. These forces are resisted by the squeeze film effect between surfaces 6 and 8.

In the squeeze film effect, the viscous resistance of oil to deformation builds up large pressures resisting the approach of two parallel planar surfaces separated by a film of oil. In the squeeze film rocker tip case, so long as the spherical surface of rocker tip 5 is free to rotate in its receiver, the squeeze film forces are large enough to maintain a fully hydrodynamic film of oil between the smooth surfaces of valve tip 8 and the rocker tip engaging surface 6. Even though the thickness of this squeeze film will be quite small, the sliding velocities between rocker tip and stem are correspondingly small. The result is that the full squeeze film of oil separating the surfaces 8 and 6 radically reduces side forces of valve actuation compared to those which occur with conventional rocker tips. At the end of the valve actuation cycle, the oil film is thinner than it was at the beginning, but again the spring 9 separates the surface and the oil film is replenished for the next valve actuating cycle. It is important that oil be supplied under enough pressure from passage 11 so that a full oil film is established between sphere 5 and its receiver surface so that sphere 5 can also engage the cam follower in squeeze-film mode. With such full-film lubrication, the rocker sphere 5 is free to rotate and establish a moment balance about itself to properly orient valve tip 8 with respect to surface 6.

The squeeze film rocker tip assembly shown in FIG. 1 is inexpensive to make and durable. The rocker tip and spherical mounting can be simply manufactured by grinding a flat surface on a conventional ball bearing. The mating surface of cam follower 3 is also simple to make. Various clip means to hold the rocker tip in the cam follower can be made. The flat surface 6 of the rocker tip should be smooth, and the end of valve tip 8 should also be smooth. A simple finger spring washer can supply the force to separate the squeeze film engaging surfaces during the unloaded part of the valve actuation cycle. Other spring means can also supply this separating force. A consistant supply of oil to the rocker tip can also be achieved in various ways.

Figure 2:
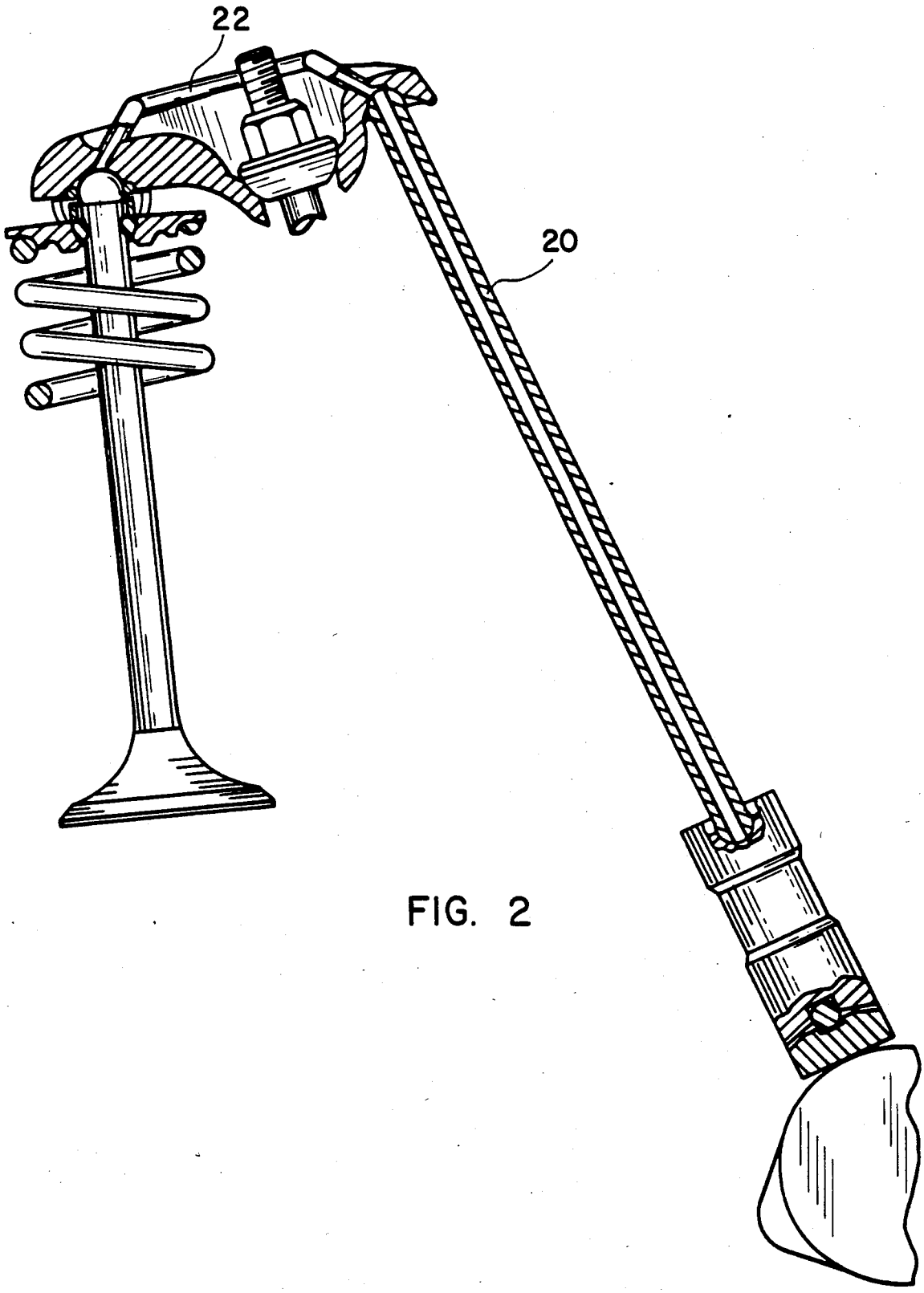
FIG. 2 illustrates the squeeze film rocker tip arrangement applied to a engine where the camshaft actuates a push rod.

The squeeze film rocker tip is equally applicable to push rod engines. This is illustrated in FIG. 2. The geometry of FIG. 2 with respect to the squeeze film rocker tip is identical to that illustrated in FIG. 1, except that the oil supply comes from the push rod 20 via a connecting passage 22.

Details may vary from those illustrated in FIGS. 1 and 2 to produce a rocker tip which radically reduces side forces on valve stems and valve guides by maintaining a squeeze film between the rocker tip and the valve stem. The basic principles are: (1) the mating of two flat surfaces, the valve tip and the rocker tip; (2) having the rocker tip free to rotate as the valve actuates; (3) having a means to assure that oil is present surrounding the rocker tip and valve tip surfaces; and (4) having a means whereby when the valve is not loaded there is a force to consistently separate the rocker tip from the valve tip. If these circumstances are arranged, squeeze film fluid mechanics will maintain a full film of oil between the rocker tip and the valve stem and side forces between rocker tip and valve stem can be radically reduced.

It is claimed:

1. A valve stem and rocker connector assembly for reducing side loads produced by the valve stem on the valve stem guides wherein the rocker is oscillated in timed sequence for valve operation, said assembly comprising a valve stem having an upper portion with a flat end opposite the valve end, a valve spring retainer mounted on the valve stem adjacent the flat end, a valve spring surrounding said stem and engaging the valve spring retainer, a spherical piece having a flat portion fitting against the flat end of the valve stem, a rocker having an end portion with a concave section conforming to and receiving a spherical portion of the piece therein; means for retaining the spherical piece in the concave section of the rocker, means to lubricate the coacting surfaces of the rocker and the spherical piece, spring means positioned between and in engagement with the confronting surfaces of the rocker and the valve spring retainer to produce a force separating the flat section of the spherical piece and the flat end of the valve stem whereby separation of said flat surfaces takes place when the valve is closed, and lubricating reservoir means providing oil for establishing an oil film between the two flat surfaces during said separation.

2. The invention as set forth in claim 1 and wherein the lubricating reservoir means providing oil for establishing an oil film between the two flat surfaces during separation thereof includes wall means surrounding the upper end portion of the valve stem up to height sufficient for flooding the periphery of the stem portion adjacent the flat section of the spherical piece.

* * * * *